US009022499B2

(12) United States Patent
Fujimoto

(10) Patent No.: US 9,022,499 B2
(45) Date of Patent: May 5, 2015

(54) PRINTING APPARATUS

(75) Inventor: Kazushi Fujimoto, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 13/424,638

(22) Filed: Mar. 20, 2012

(65) Prior Publication Data

US 2012/0256980 A1 Oct. 11, 2012

(30) Foreign Application Priority Data

Apr. 7, 2011 (JP) ..... 2011-085647

(51) Int. Cl.

| | |
|---|---|
| ***B41J 29/38*** | (2006.01) |
| ***B41J 2/045*** | (2006.01) |
| ***B41J 2/165*** | (2006.01) |
| ***B41J 2/21*** | (2006.01) |

(52) U.S. Cl.

CPC ..... *B41J 2/0451* (2013.01); *B41J 2/04565* (2013.01); *B41J 2/0458* (2013.01); *B41J 2/16579* (2013.01); *B41J 2/2142* (2013.01)

(58) Field of Classification Search

CPC ..... B41J 2/0451; B41J 2/04565

USPC ..... 347/14

See application file for complete search history.

(56) References Cited

U.S. PATENT DOCUMENTS

| | | | | |
|---|---|---|---|---|
| 4,774,526 | A * | 9/1988 | Ito | 347/171 |
| 6,224,183 | B1 * | 5/2001 | Kono et al. | 347/19 |
| 2002/0140756 | A1 | 10/2002 | Kuriyama et al. | |
| 2010/0156982 | A1 | 6/2010 | Sasagawa | |

FOREIGN PATENT DOCUMENTS

| | | | |
|---|---|---|---|
| CN | 1919603 | A | 2/2007 |
| EP | 0 394 699 | A1 | 10/1990 |
| JP | 11-188853 | A | 7/1999 |
| JP | 2001-315363 | A | 11/2001 |

OTHER PUBLICATIONS

Office Action issued in Chinese Application No. 201210096933.6 dated May 4, 2014.

* cited by examiner

*Primary Examiner* — Manish S Shah
*Assistant Examiner* — Jeffrey C Morgan
(74) *Attorney, Agent, or Firm* — Fitzpatrick, Cella, Harper & Scinto

(57) ABSTRACT

The nozzle failure determination result of discharge failure detection does not consider the heater state of a nozzle, so even a nozzle failure caused by nozzle clogging or the like is determined as a failure. The heater state of an abnormal nozzle can be determined only after driving once, causing a nozzle to be damaged unwantedly. This invention has been made to solve this problem. Whether a nozzle failure has occurred is determined based on the results of both a discharge failure detection operation and heater resistance measurement operation. Detection can be achieved quickly by performing heater resistance measurement during the quiescent period in the discharge failure detection operation. When the discharge failure detection operation is executed after heater resistance measurement, driving of an abnormal nozzle and an unwanted damage to a nozzle can be prevented.

7 Claims, 10 Drawing Sheets

PRINTING APPARATUS

BACKGROUND OF THE INVENTION

1. Field of the Invention

The present invention relates to a printing apparatus, particularly to a printing apparatus which prints using a plurality of printheads.

2. Description of the Related Art

A printer which prints information such as a desired character or image on a sheet-like printing medium such as paper or a film is widely used as an information output apparatus for a word processor, personal computer, facsimile apparatus, or the like.

Various methods are known as printing methods of a printer. Recently, an inkjet method especially receives attention because it allows non-contact printing on a printing medium, can easily print in color, and is very quiet. The arrangement according to the inkjet method popularly adopts a serial method because of low cost, easy downsizing of the apparatus, and the like. In this method, a printhead for discharging ink in accordance with a printing instruction is mounted, and prints while reciprocally scanning the printhead in a direction perpendicular to the printing medium conveyance direction.

The inkjet printing apparatus (to be referred to as a printing apparatus) implements higher-resolution image printing by decreasing the ink discharge amount per dot while increasing the integration degree of nozzles for discharging an ink droplet. To obtain higher image quality, a variety of techniques have been proposed, including a technique of simultaneously printing with inks of four basic colors (cyan, magenta, yellow, and black), light color inks prepared by decreasing the dye concentrations of these color inks, and special color inks of red, green, blue, and the like.

Even a decrease in printing speed which may occur along with improvement of the image quality has been suppressed satisfactorily by increasing the number of integrated printing elements, increasing their drive frequency, and introducing a printing technique of printing in reciprocal scanning of the printhead, such as reciprocal printing. In a printhead including many printing elements, a printing element failure might occur over time in accordance with the use frequency. Even though many printing elements are normal, if only one printing element fails, the image quality degrades.

Especially in photographic image printing requested recently, occurrence of only some printing element failures makes actual use of the printhead difficult. As a countermeasure against this, various printing element failure detection methods, recovery methods or printing methods corresponding to detection results, and the like have already been proposed (see Japanese Patent Laid-Open Nos. 11-188853 and 2001-315363).

As a conventional element failure detection method, an ink discharge state from a nozzle of a printhead is detected using a photosensor. There is also a method of detecting an ink discharge state from a nozzle of a printhead using an electrode which detects, via ink, a voltage change between a printing element which receives energy to discharge ink and a driving element for driving the printing element. There are also known a method of printing a stepwise pattern on a printing medium using all printing elements and determining an unprinted portion of the pattern using a photosensor, and a method of discharging a charged ink droplet onto an electrode and detecting an ink discharge state from a potential change of the electrode at that time.

However, the conventional detection methods cannot determine whether the detection result is derived from a printing element itself or merely clogging of a nozzle with an ink droplet, dust, or the like.

There are also proposed a method of identifying a printing element failure in inspection before shipping of a printhead and storing the information into the printhead, and a method of storing in advance information about an element which is highly likely to fail, and decreasing the drive frequency of this element. In this case, no problem occurs upon shipping of a printhead, but neither the use environment nor aging of the printhead is satisfactorily coped with.

SUMMARY OF THE INVENTION

Accordingly, the present invention is conceived as a response to the above-described disadvantages of the conventional art.

For example, a printing apparatus according to this invention is capable of implementing high-speed printing while improving the detection precision of the nozzle state of a printhead.

According to one aspect of the present invention, there is provided a printing apparatus comprising: a printhead including a plurality of nozzles each including a heater; a first generation unit configured to generate a data signal and a timing signal for the printhead to measure a resistance of the heater; a second generation unit configured to generate a data signal and a timing signal for the printhead to detect an ink droplet discharge failure from the printhead; a power supply unit configured to supply a first drive voltage to be applied to the printhead upon measuring the resistance of the heater and a second drive voltage applied to the printhead upon detecting the ink droplet discharge failure, the second drive voltage being higher than the first drive voltage; and a control unit configured to control execution of measurement of the resistance of the heater and execution of detection of the ink droplet discharge failure.

The invention is particularly advantageous since the nozzle state of a printhead can be detected at higher precision by performing both measurement of the resistance of a heater included in a nozzle and detection of an ink droplet discharge failure from the printhead.

For example, when a plurality of printheads are arranged, measurement can be performed quickly by parallelly executing measurement of the resistance of a heater on a given printhead and detection of an ink droplet discharge failure from another printhead.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings. Note that an arrangement to be disclosed in the following embodiment is merely illustrative, and the present invention is not limited to the illustrated arrangement.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") includes an ink orifice or a liquid channel communicating with it, and an element for generating energy used to discharge ink, unless otherwise specified.

Figure 1:
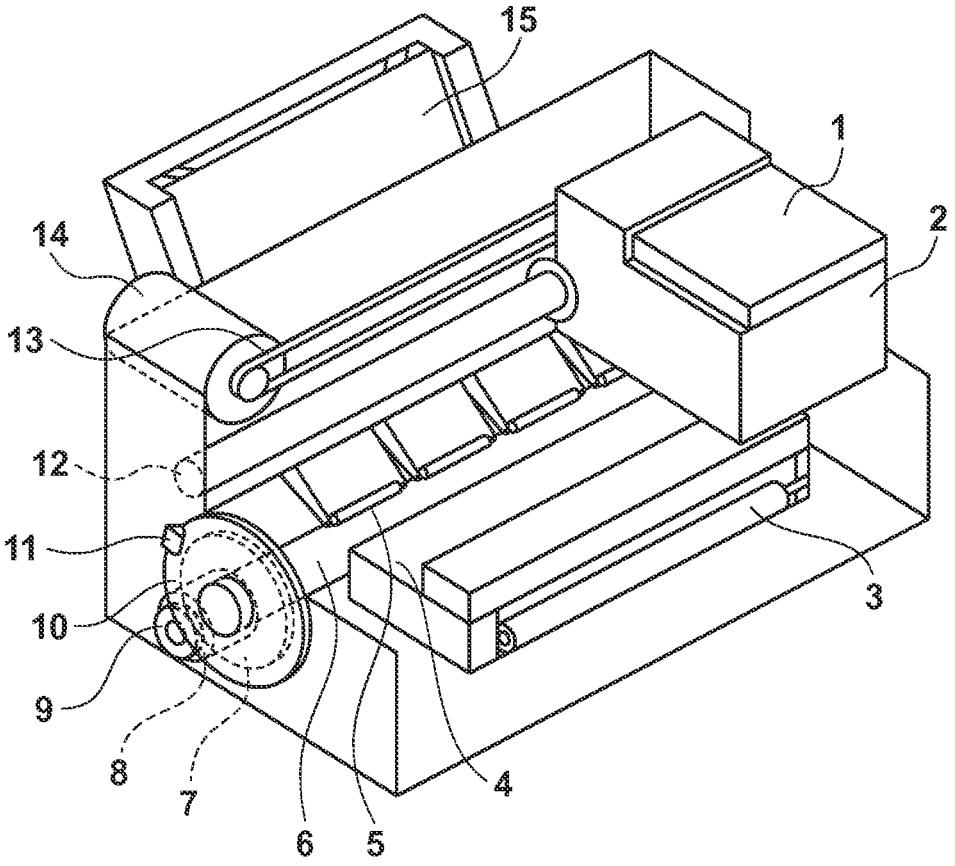
FIG. 1 is a perspective view showing the main mechanism of an inkjet printing apparatus as a typical embodiment of the present invention.

FIG. 1 is a perspective view showing the main mechanism of an inkjet printing apparatus (to be referred to as a printing apparatus) as a typical embodiment of the present invention.

Referring to FIG. 1, a carriage 2 which supports an inkjet printhead (to be referred to as a printhead) 1 including a nozzle array formed from a plurality of nozzles for discharging ink reciprocally moves in the scanning direction perpendicular to the printing medium conveyance direction, printing on a printing medium. The carriage 2 is fixed to a belt 13, and slidably attached to a shaft 12. As a carriage motor 14 moves the belt 13, the carriage 2 attached to the belt 13 also moves. Each of the nozzles includes a heater for heating ink and discharging it as an ink droplet from the nozzle.

A discharge roller 3 conveys the printed printing medium outside the apparatus. A platen 4 is arranged below a surface opposite to the printing surface of a printing medium to face the ink discharge surface of the printhead 1. In printing, a printing medium 15 such as printing paper is pressed by a paper press roller 5, and conveyed along with the progress of printing by a conveyance roller 6 which receives the drive force of a conveyance motor 8 via a conveyance gear 7 and conveyance motor gear 9.

An encoder film 10 is attached around the conveyance gear 7, and rotates in synchronism with rotation of the conveyance motor 8. An encoder sensor 11 is used to detect slits formed in the encoder film 10 at a predetermined interval, generating an encoder signal. Based on this signal, the conveyance position of the printing medium 15 is detected, and the print timing is generated.

Figure 2:
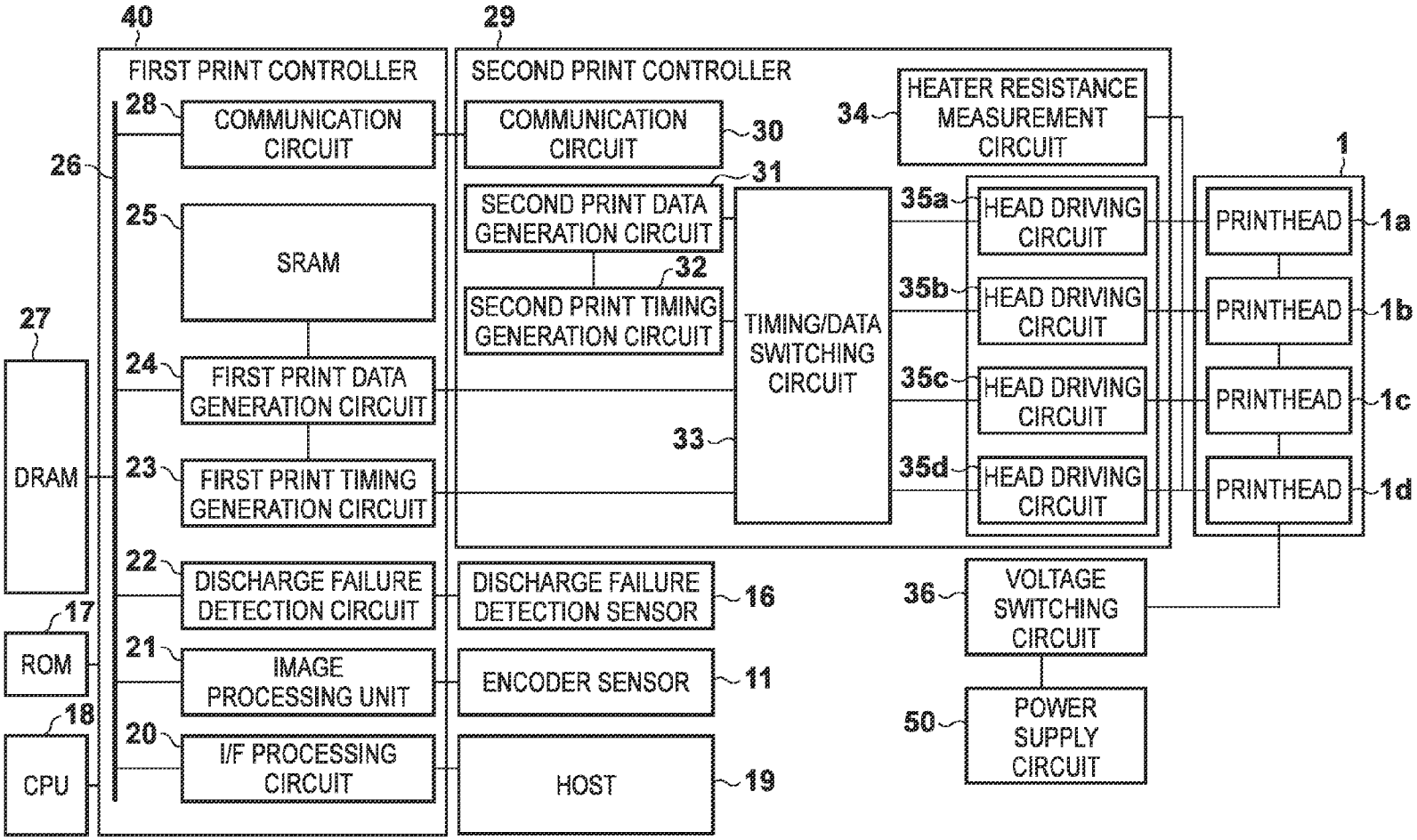
FIG. 2 is a block diagram showing the control arrangement of the printing apparatus shown in FIG. 1.

FIG. 2 is a block diagram showing the control arrangement of the printing apparatus shown in FIG. 1.

As shown in FIG. 2, the control arrangement is generally divided into two portions: a first print controller 40 having an interface with a host 19; and a second print controller 29 which controls to drive the printhead 1. The first print controller 40 and second print controller 29 include communication circuits 28 and 30, respectively. The first print controller 40 and second print controller 29 can exchange information with each other via these communication circuits. The first print controller 40 and second print controller 29 are implemented by, for example, an ASIC or SOC (System On Chip). A power supply circuit 50 generates two types of voltages to be supplied to the printhead. A voltage switch circuit 36 selectively supplies a voltage generated by the power supply circuit 50, to the printhead 1. In addition to the power supply circuit 50, the printing apparatus includes another power supply circuit (not shown) which generates a logic voltage to be supplied to the CPU 18, first print controller 40, and second print controller 29, and a motor voltage used for driving the carriage motor 14 and conveyance motor 8.

An interface (I/F) circuit 20 receives a control command and print data transmitted from the host 19. A CPU 18 analyzes the received control command, and controls the printing apparatus in accordance with the control command. The received print data is transferred to an image processing unit 21 via a common bus 26, undergoes various image processes corresponding to a printing method, and is stored in a large-capacity DRAM 27 again via the common bus 26.

The DRAM 27 stores at least print data used for printing by one scanning of the printhead. The DRAM 27 further stores an image mask used in multi-pass printing or printing of distributing print data to two nozzles, the result of detection by a discharge failure detection sensor 16 formed from an optical sensor or the like, and the result of detection by a heater resistance measurement circuit 34 (to be described later).

The CPU 18 analyzes the result of detection by the discharge failure detection sensor 16 and the result of detection by the heater resistance measurement circuit 34, and uses them as discharge failure nozzle information.

The CPU 18 controls the whole printing apparatus in accordance with a program stored in advance in a ROM 17 and a control command input from the host 19 via the I/F circuit 20. Note that the ROM 17 stores programs for operating the CPU 18, various tables necessary to control the printhead 1, and the like.

A first print data generation circuit 24 reads out print data stored in the DRAM 27 at a timing generated by a first print timing generation circuit 23 using the detection value of an encoder sensor 11 as a reference in accordance with a print start instruction from the CPU 18. The print data are temporarily stored in an SRAM 25, and after all print data corresponding to one nozzle array of the printhead 1 are obtained, the first print data generation circuit 24 transfers them to the second print controller 29 again.

The second print controller 29 drives the printhead 1 using print data and a timing signal which are transferred from the first print controller 40. Alternatively, the second print controller 29 may drive the printhead 1 using print data and a timing signal which are generated by a second print data generation circuit 31 and second print timing generation circuit 32, respectively. A timing/data switch circuit 33 in the second print controller 29 performs this switching.

In the embodiment, a discharge failure detection operation by the discharge failure detection sensor 16 uses print data and a timing signal which are generated by the first print data generation circuit 24 and first print timing generation circuit 23, respectively. The first print data generation circuit 24 generates data for driving the heater of a nozzle to undergo discharge failure detection. In other words, the first print data generation circuit 24 generates data for designating a nozzle to undergo discharge failure detection. Discharge failure detection can therefore be performed for each nozzle. To the contrary, a heater resistance measurement operation by the heater resistance measurement circuit 34 uses print data and a timing signal which are generated by the second print data generation circuit 31 and second print timing generation circuit 32, respectively. The second print data generation circuit 31 generates data for driving the heater of a nozzle to undergo heater resistance measurement. That is, the second print data generation circuit 31 generates data for designating a nozzle to undergo heater resistance measurement. Hence, heater resistance measurement can be performed for each nozzle. A head driving circuit 35 selectively drives the printhead 1 using print data and a timing signal necessary for each operation. The first print data generation circuit 24 and first print timing generation circuit 23 will be collectively called the first generation circuit. The second print data generation circuit 31 and second print timing generation circuit 32 will be collectively called the second generation circuit.

As is apparent from FIG. 2, the printhead 1 is divided into printheads 1*a*, 1*b*, 1*c*, and 1*d* in correspondence with inks of four colors (cyan, magenta, yellow, and black) used. The head driving circuit 35 is also divided into four head driving circuits 35*a*, 35*b*, 35*c*, and 35*d* in correspondence with the respective printheads.

Next, several embodiments of an ink discharge failure detection (discharge failure detection) operation for the printhead using the printing apparatus having the above arrangement will be described.

First Embodiment

Discharge failure detection according to the first embodiment is performed by detecting an ink discharge state from a nozzle of a printhead 1, using a discharge failure detection sensor such as a photosensor, and measuring the resistance of a heater (printing element) in each of nozzles of the printhead 1.

Measurement of Heater Resistance

Figure 3:
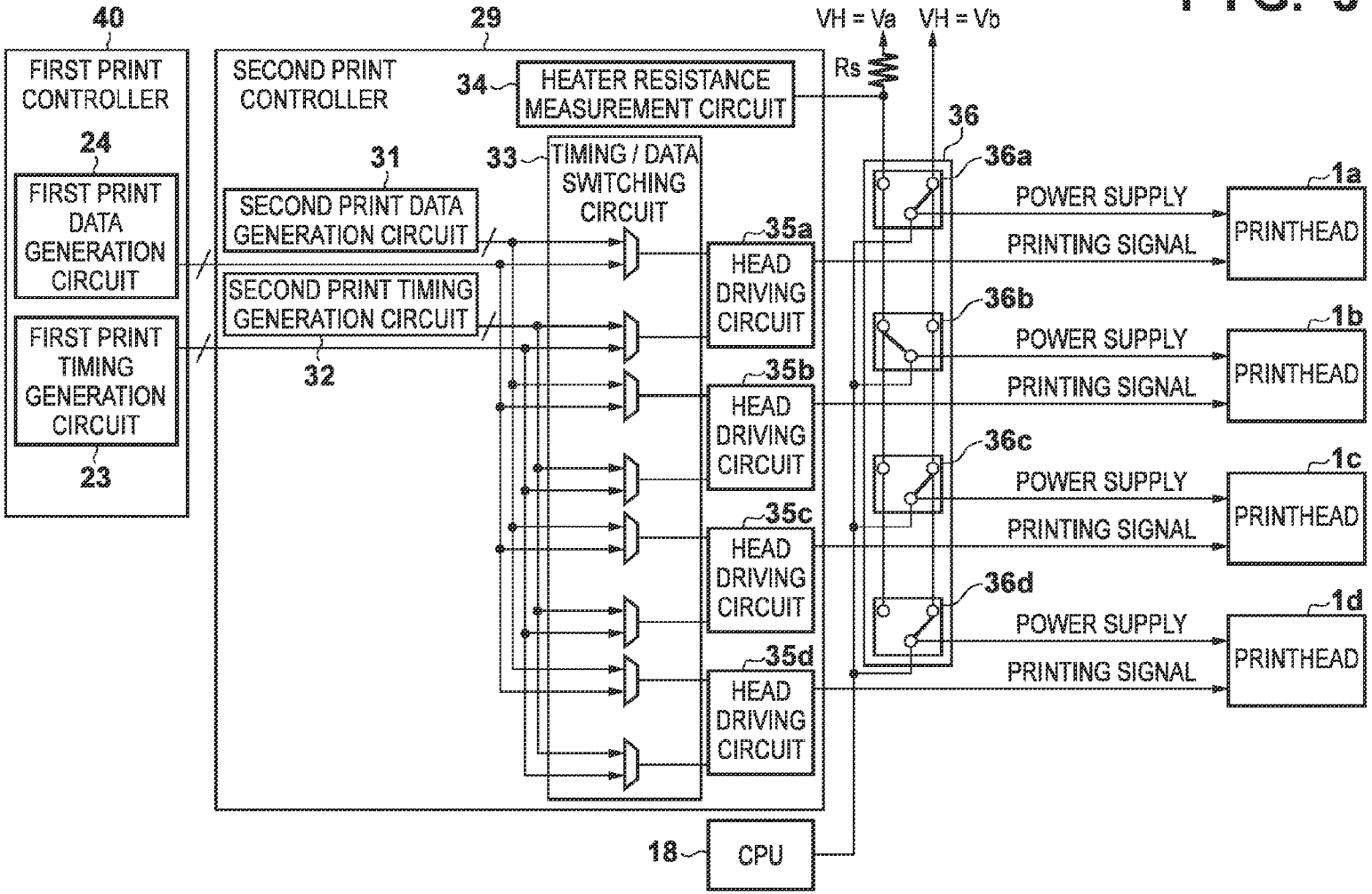
FIG. 3 is a block diagram showing the detailed arrangement of a control circuit.

FIG. 3 is a circuit block diagram showing the detailed arrangement of a voltage switch circuit, head driving circuit, and timing/data switch circuit.

As shown in FIG. 3, the voltage switch circuit 36 is divided into four portions in correspondence with four printheads 1*a*, 1*b*, 1*c*, and 1*d*. Each of four voltage switch circuits 36*a*, 36*b*, 36*c*, and 36*d* switches between a voltage used in normal printing and a voltage used to measure a heater resistance, which are applied to a corresponding printhead. Note that a power supply circuit 50 generates voltages Va and Vb.

A heater resistance measurement operation will be explained.

A predetermined voltage is applied to the heater of a nozzle serving as a measurement target. After a flowing current stabilizes, the value is converted into a voltage value using a detection resistor Rs. Then, a heater resistance measurement circuit 34 formed from an A/D converter or the like measures the resistance.

Figure 4:
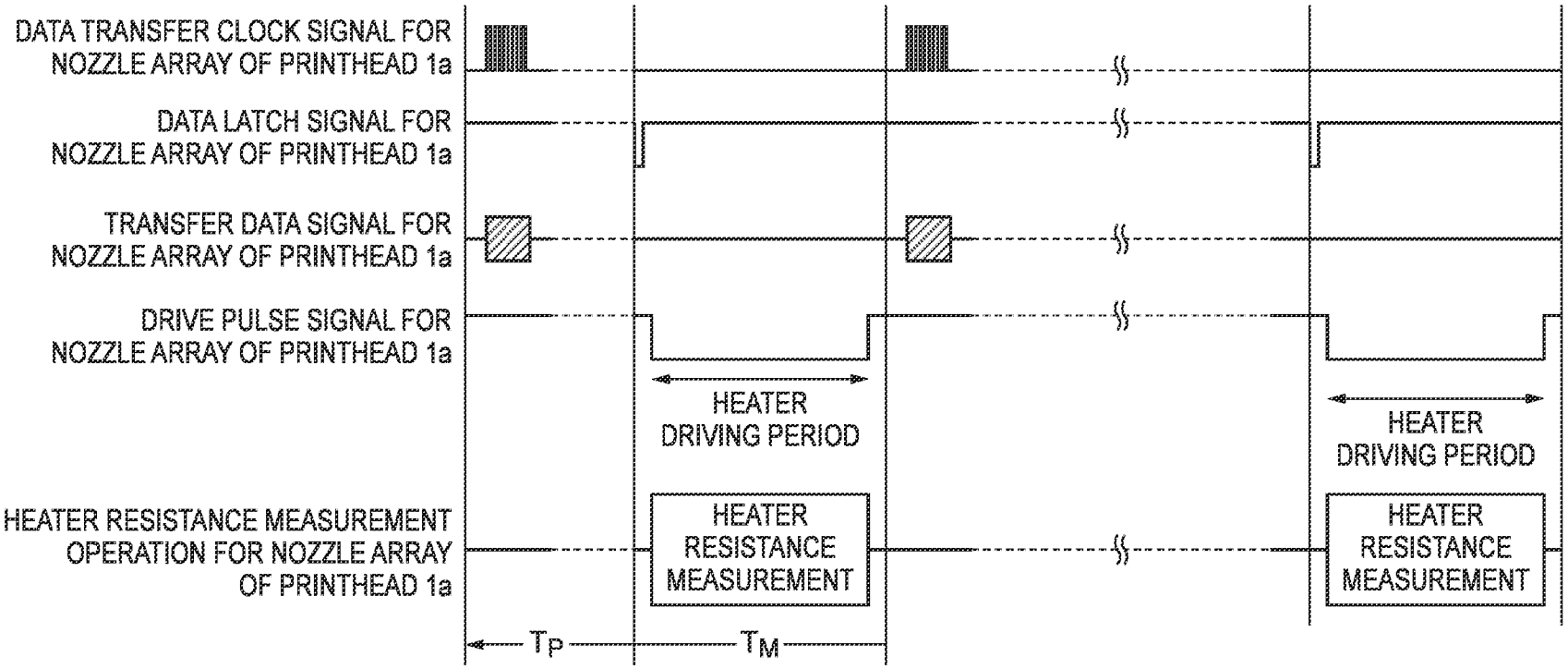
FIG. 4 is a chart showing the waveform of a signal pulse for driving a printhead when measuring a heater resistance.

FIG. 4 is a chart showing the waveform of a signal pulse for driving the printhead 1*a* when measuring a heater resistance.

In the first embodiment, data and a timing signal for measuring a heater resistance are generated using a second print data generation circuit 31 and second print timing generation circuit 32.

The time until a current flowing through a heater stabilizes generally needs to be longer than a print period $T_P$ in a print operation, as shown in FIG. 4. For this reason, a heater resistance measurement time $T_M$ is longer than the print period. When measuring a heater resistance, the second print data generation circuit 31 generates a drive pulse longer than a normal drive pulse, and inputs it to the printhead 1*a* via a head driving circuit 35*a*. In this case, if the drive voltage has the same drive voltage value as that in normal printing, an excessive current flows through a heater. To prevent this, a drive voltage value to be input to the printhead 1*a* is set to a level not to damage the heater even if the heater resistance is measured. That is, a drive voltage value VH=Va (Va<Vb). In general, this voltage value (first drive voltage) is about 3.3 V to 5 V. In contrast, the voltage Vb (second drive voltage) is used in normal printing, and the voltage value is higher than the first drive voltage and is about 15 V to 20 V.

In FIG. 4, measurement of the heater resistance of the printhead 1*a* has been explained. However, this also applies to measurement of the heater resistances of the printheads 1*b* to 1*d*.

Discharge Failure Detection Operation Using Discharge Failure Detection Sensor

An ink droplet is actually discharged from a nozzle serving as a measurement target, and the discharge state is detected by using a discharge failure detection sensor 16 such as a photosensor, thereby detecting a nozzle failure.

Figure 5:
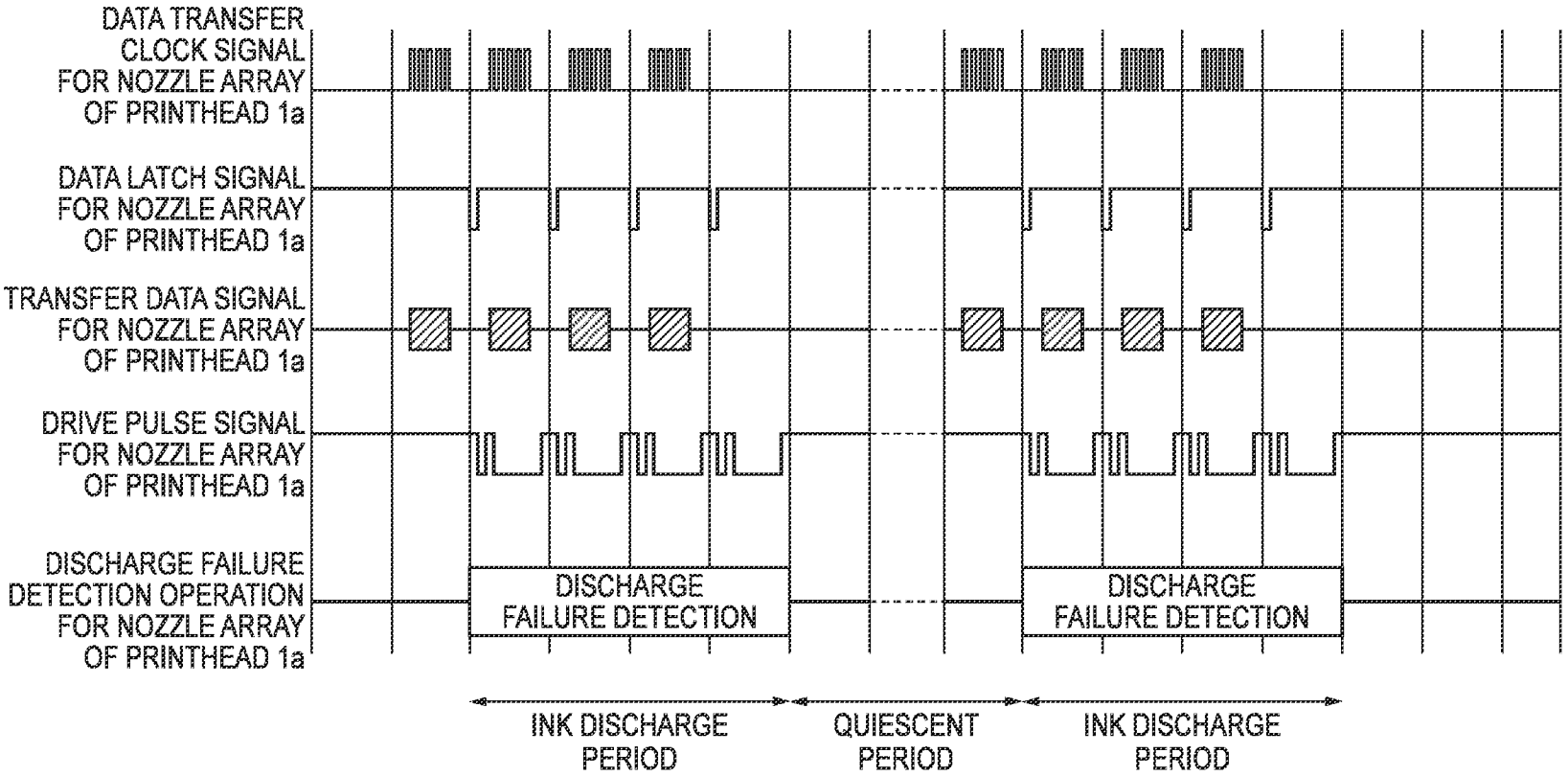
FIG. 5 is a chart showing the waveform of a signal pulse used in a discharge failure detection operation for the printhead.

FIG. 5 is a chart showing the waveform of a signal pulse used in the discharge failure detection operation for the printhead 1*a*.

In the first embodiment, data and a timing for performing the discharge failure detection operation are generated using a first print data generation circuit 24 and first print timing generation circuit 23.

In the discharge failure detection operation, the printhead 1*a* is driven, similar to a normal print operation. Considering stabilization of discharge, the printhead is driven while repeating a discharge period and quiescent period for each nozzle, as shown in FIG. 5. The drive voltage value is set equal to the drive voltage in a normal print operation to be VH=Vb (Va<Vb).

In FIG. 5, the discharge failure detection operation for the printhead 1*a* has been described. However, this also applies to the discharge failure detection operations of the printheads 1*b* to 1*d*.

As described above, according to the first embodiment, two print data generation circuits and two print timing generation circuits are used to generate data and timing signals for the heater resistance measurement operation and discharge failure detection operation. The voltage switch circuit switches between drive voltages used for the respective operations. Thus, data signals, timing signals, and drive voltages corresponding to the discharge failure detection operation and heater resistance measurement operation can be generated for one printhead 1.

In nozzle failure determination, the nozzle state of the printhead can be determined more accurately based on the results of both the discharge failure detection operation of detecting a nozzle discharge state and the heater resistance measurement operation of measuring the resistance of the heater itself of a nozzle. Whether or not a resistance measured by the heater resistance measurement circuit 34 is normal is determined (defective/non-defective determination) by the following method. For example, as the first determination method, if a resistance measured by the heater resistance measurement circuit 34 falls within a predetermined resistance range, it is determined that the heater is non-defective. This predetermined resistance range is a range defined by specifications in the manufacture of the printhead. If a resistance measured by the heater resistance measurement circuit 34 falls outside this resistance range, it is determined that the heater is defective. Note that the printhead 1*a* has been described. However, heater resistance measurement and discharge failure detection can be performed separately for each of the printheads 1*a* to 1*d*.

Second Embodiment

The first embodiment is premised on that heater resistance measurement and the discharge failure detection operation are executed at different timings. The second embodiment will describe an example in which heater resistance measurement is performed parallelly during execution of discharge failure detection.

Figure 6:
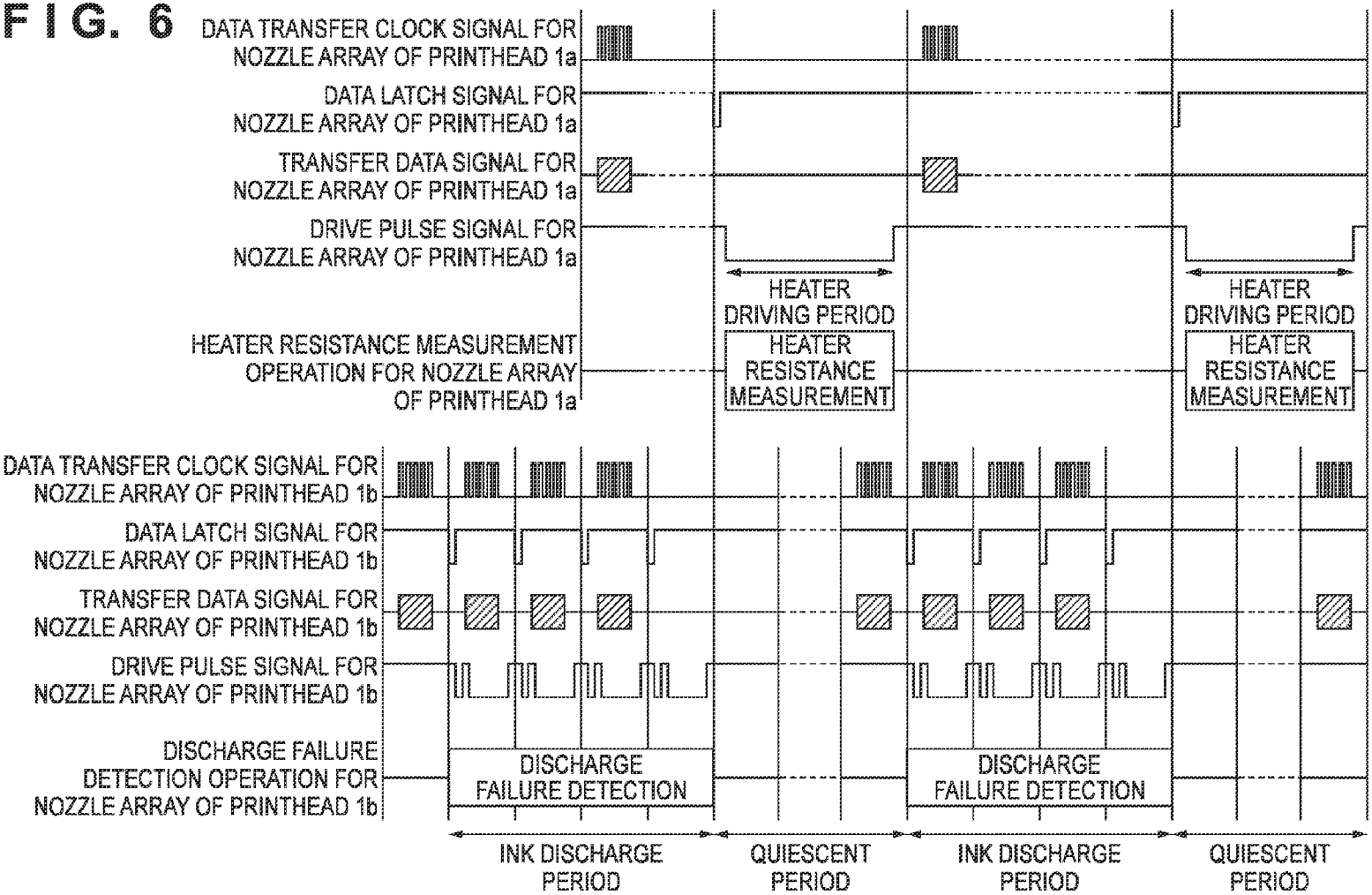
FIG. 6 is a chart showing the operation timings of heater resistance measurement and discharge failure detection.

FIG. 6 is a chart showing the operation timings of heater resistance measurement and discharge failure detection. As shown in FIG. 6, the discharge failure detection period is divided into an ink discharge period during which ink is discharged from the printhead, and a quiescent period during which no ink is discharged from the printhead. In the second embodiment, as shown in FIG. 6, it is controlled to execute heater resistance measurement for the nozzle array of a printhead 1*a* in the quiescent period of the discharge failure detection operation for the nozzle array of a printhead 1*b*.

This can be achieved by executing the following control.

More specifically, a voltage switch circuit 36*b* selects the drive voltage VH=Vb (>Va) to apply a normal drive voltage to the printhead 1*b*. In addition, a first print data generation circuit 24 and first print timing generation circuit 23 supply a data signal and timing signal for the discharge failure detection operation. During the quiescent period in this operation period, a voltage switch circuit 36*a* selects the drive voltage VH=Va (<Vb) to apply a low voltage to a printhead 1*a*. At this time, a second print data generation circuit 31 and second print timing generation circuit 32 supply a data signal and timing signal for measuring a heater resistance.

In FIG. 6, only the relationship between the printheads 1*a* and 1*b* has been explained. However, the same control also applies to even the remaining printheads.

Figure 7:
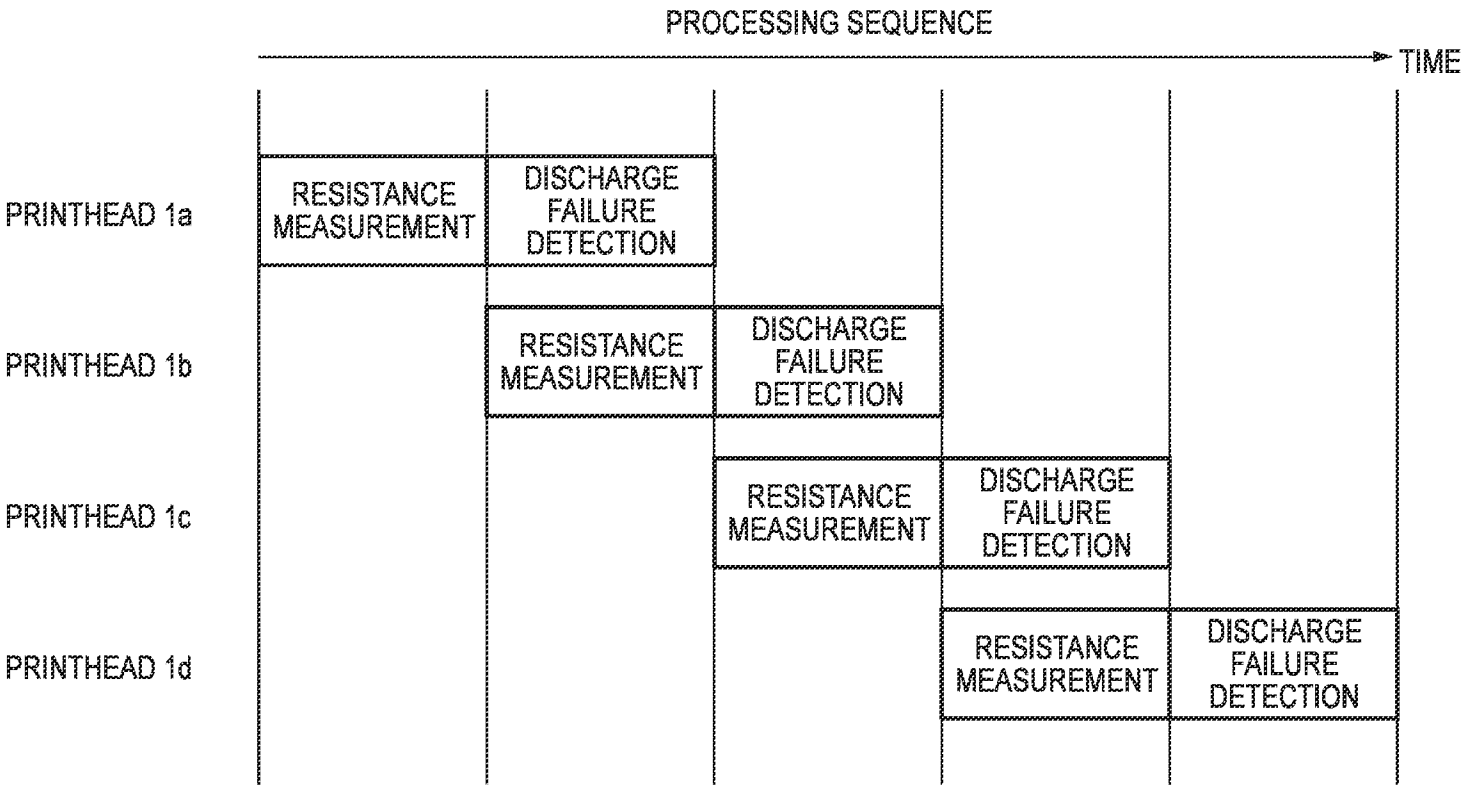
FIG. 7 is a chart showing pipeline processing of the discharge failure detection operation and heater resistance measurement operation.
Figure 10:
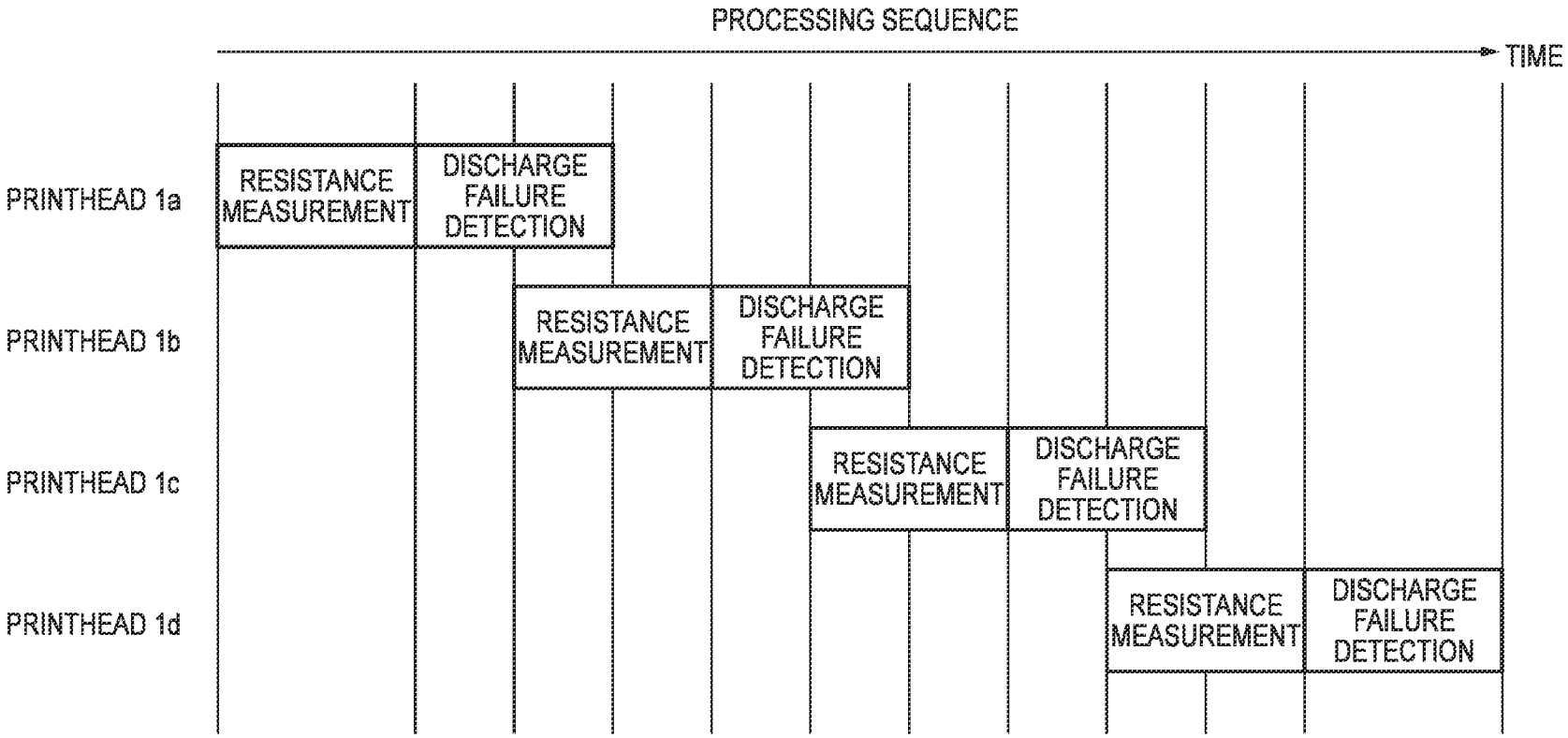
FIG. 10 is a chart showing another processing of the discharge failure detection operation and heater resistance measurement.

FIG. 7 is a chart showing an operation timing when performing heater resistance measurement and the discharge failure detection operation in a pipeline manner for the printheads 1*a* to 1*d*. After the end of heater resistance measurement for the printhead 1*a*, heater resistance measurement for the printhead 1*b* and the discharge failure detection operation for the printhead 1*a* are executed simultaneously. Then, heater resistance measurement for a printhead 1*c* and the discharge failure detection operation for the printhead 1*b* are executed simultaneously. Thereafter, heater resistance measurement for a printhead 1*d* and the discharge failure detection operation for the printhead 1*c* are executed simultaneously. Finally, the discharge failure detection operation for the printhead 1*d* is executed. Note that the present invention is not limited to simultaneously executing the heater resistance measurement operation and discharge failure detection operation. For example, part of the period of the heater resistance measurement operation and part of the period of the discharge failure detection operation may be executed at the same time, as shown in FIG. 10. In FIG. 10, the first print data generation circuit 24 and first print timing generation circuit 23 operate so that resistance measurement for the printhead 1*b* starts during the discharge failure detection operation for the printhead 1*a*.

Figure 8:
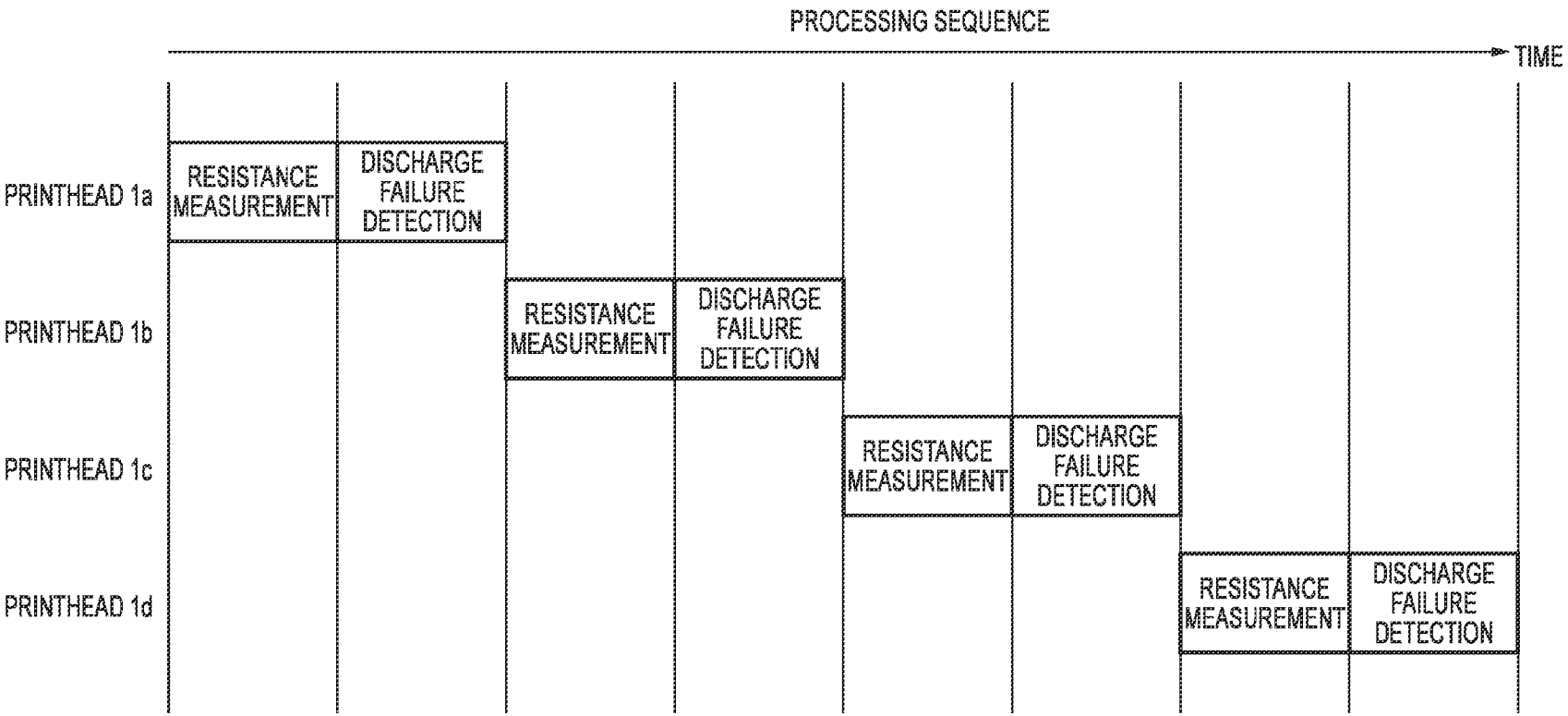
FIG. 8 is a chart showing serial processing of the discharge failure detection operation and heater resistance measurement operation.

FIG. 8 is a chart showing an operation timing when executing heater resistance measurement and the discharge failure detection operation time-sequentially for the printheads 1*a* to 1*d*. A comparison between FIGS. 8 and 7 reveals that the detection time can be greatly shortened by parallelly executing the two operations.

According to the above-described embodiment, heater resistance measurement for a given printhead is parallelly performed during execution of discharge failure detection for another printhead. The nozzle state can therefore be detected accurately at high speed without the influence of noise from the detection operations of these printheads.

Third Embodiment

The first and second embodiments have not particularly limited the order of heater resistance measurement and the discharge failure detection operation. The third embodiment will describe an example in which the order of the two operations is set so that heater resistance measurement is executed first and then the discharge failure detection operation is executed.

Figure 9:
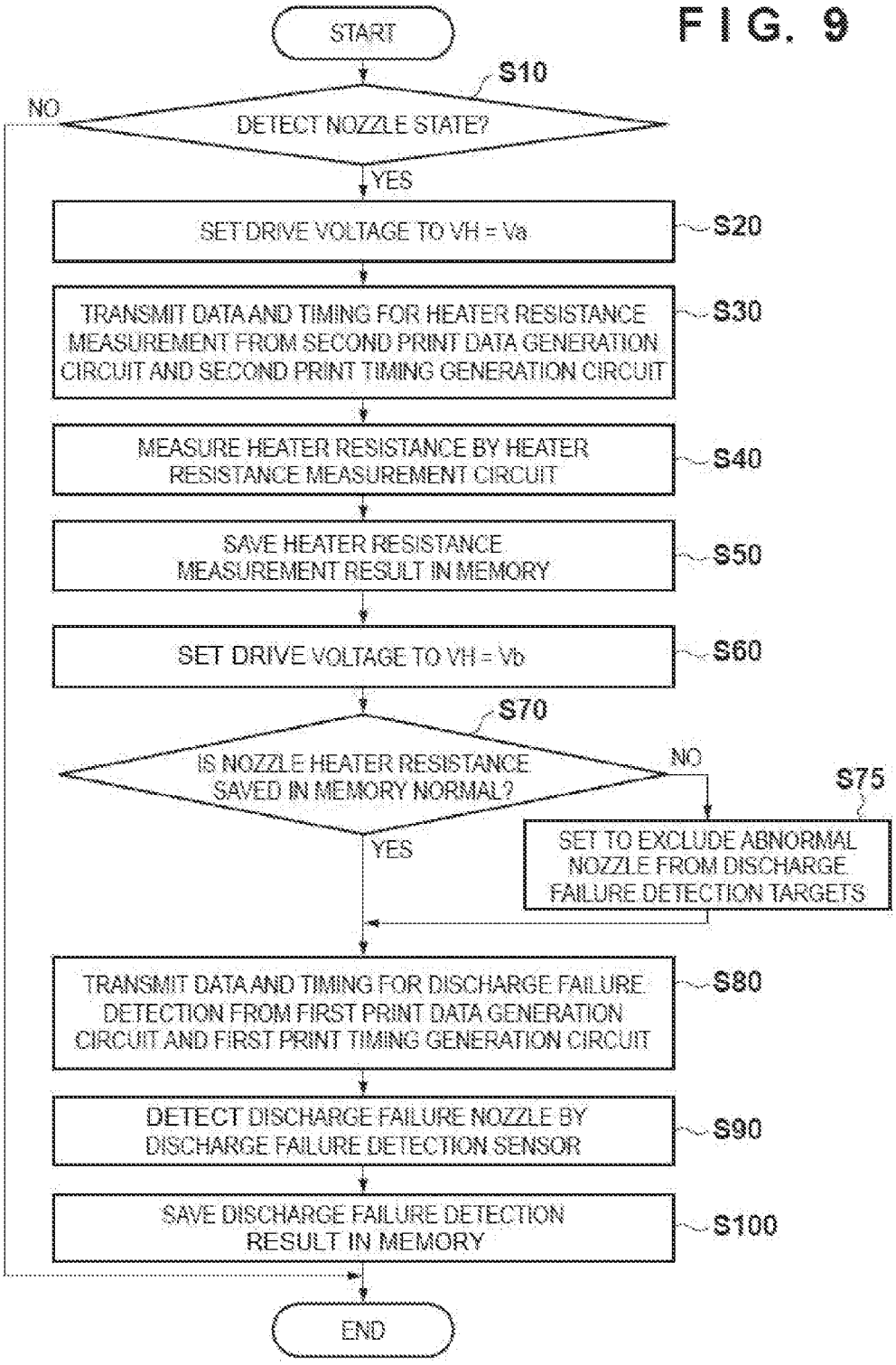
FIG. 9 is a flowchart showing the discharge failure detection operation and heater resistance measurement processing.

FIG. 9 is a flowchart showing ink discharge failure detection processing for the printhead.

If a CPU 18 issues an instruction to execute ink discharge failure detection processing in step S10, the process advances to step S20 to set a drive voltage VH selected by voltage switch circuits 36*a* to 36*d* to be VH=Va. In step S30, a second print data generation circuit 31 and second print timing generation circuit 32 generate a data signal and timing signal for measuring a heater resistance, respectively, and supply them to head driving circuits 35*a* to 35*d* via a timing/data switch circuit 33.

In step S40, the head driving circuits 35*a* to 35*d* supply data signals and timing signals to printheads 1*a* to 1*d* via the corresponding voltage switch circuits 36*a* to 36*d*, and a heater resistance measurement circuit 34 measures a heater resistance. In step S50, the measurement value is saved in a memory (for example, an SRAM 25 or DRAM 27).

In step S60, the drive voltage VH to be selected by the voltage switch circuits 36*a* to 36*d* is set to VH=Vb. In step S70, it is checked whether or not the measured heater resistance saved in the memory is normal. If this value is normal, the process advances to step S80. If there is a nozzle having an abnormal heater resistance, the process advances to step S75. In step S75, the nozzle is excluded from discharge failure detection targets. In this case, this is achieved by holding discharge failure detection target nozzle information in the SRAM 25 and excluding the nozzle from that information. In step S80, a first print data generation circuit 24 and first print timing generation circuit 23 generate a data signal and timing signal for executing discharge failure detection, respectively, and supply them to the head driving circuits 35*a* to 35*d* via the timing/data switch circuit 33. Based on the discharge failure detection target nozzle information held in the SRAM 25, the first print data generation circuit 24 and first print timing generation circuit 23 generate a data signal and timing signal, respectively.

In step S90, the head driving circuits 35*a* to 35*d* supply the data signal and timing signal to the printheads 1*a* to 1*d* via the corresponding voltage switch circuits 36*a* to 36*d*. A discharge failure detection sensor 16 optically detects a discharge failure nozzle. In step S100, the detection result is saved in the memory (for example, the SRAM 25 or DRAM 27).

According to the above-described embodiment, in detection processing, the heater resistance measurement operation is executed first, and then the discharge failure detection operation by the discharge failure detection sensor is executed while reflecting the heater resistance measurement result. By defining the execution order of the two operations, unnecessary execution of the discharge failure detection operation can be suppressed, and defective/non-defective determination of a nozzle of the printhead can be performed within a short time.

It is also possible to execute the discharge failure detection operation after even a nozzle determined to be normal in heater resistance measurement undergoes a suction recovery operation or the like to recover the nozzle state. For example, after ink clogging is eliminated, the discharge failure detection operation is performed, and a more accurate nozzle state can be determined.

When a nozzle failure is detected in a subsequent discharge failure detection operation, the nozzle failure may arise from ink clogging or the like. Thus, the discharge failure detection operation can be executed again after the suction recovery operation.

The first to third embodiments have been described separately, but the present invention is not limited to this. For example, all or two of the first to third embodiments can be combined. In these cases, the effects of the combined embodiments can be achieved. A method of determining whether or not a resistance measured by the heater resistance measurement circuit 34 is normal may be different from the above-described method. For example, the upper limit value of the resistance may be set. The resistance may be determined to be normal if it is lower than/equal to the upper limit value, or abnormal if it is higher than the upper limit value. Alternatively, the lower limit value of the resistance may be set. The resistance may be determined to be normal if it is higher than/equal to the lower limit value, or abnormal if it is lower than the lower limit value.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-085647, filed Apr. 7, 2011, which is hereby incorporated by reference herein in its entirety.

What is claimed is:

1. A printing apparatus comprising:

a control unit configured to supply a first drive voltage for measuring a resistance of a heater to first and second printheads, each including a nozzle and a heater; and a determination unit configured to determine whether each of a first measurement result of the resistance of the heater included in the first printhead and a second measurement result of the resistance of the heater included in the second printhead is satisfied with a predetermined condition, wherein the control unit supplies a second drive voltage for detecting an ink droplet discharge failure to the first printhead in a case where the determination unit determines that the first measurement result is satisfied with the predetermined condition and the second measurement result is not satisfied with the predetermined condition, the second drive voltage being higher than the first drive voltage.

2. The apparatus according to claim 1, further comprising a detection unit configured to optically detect ink droplets discharged from the first and second printheads for the detection of the ink droplet discharge failure.

3. The apparatus according to claim 1, wherein a drive pulse used for measuring the heater resistance longer than a drive pulse supplied to the first and second printheads in a normal print operation is generated.

4. The apparatus according to claim 1, wherein the control unit is further configured to, when the determination unit is measuring the resistance of the heaters, control to select the first drive voltage, supply a data signal and timing signal to the first and second printheads, and drive the first and second printheads by the first drive voltage, and when detecting the ink droplet discharge failure from the first and second printheads, control to select the second drive voltage, supply a data signal and timing signal to the first and second printheads, and drive the first and second printheads by the second drive voltage.

5. The apparatus according to claim 1, further comprising an exclusion unit configured to exclude the second printhead from ink discharge failure detection targets in a case where the first measurement result satisfies the predetermined condition but the second measurement condition does not satisfy the predetermined condition.

6. The apparatus according to claim 1, further comprising the first and second printheads.

7. The apparatus according to claim 1, wherein in a case where a nozzle failure on the first printhead is detected, a suction recovery operation is performed for the first printhead, and then a detection operation of the ink droplet discharge failure is performed for the first printhead.

* * * * *